United States Patent [19]

Ciaramitaro et al.

[11] Patent Number: 4,637,848

[45] Date of Patent: Jan. 20, 1987

[54] HIGH DENSITY GEL EXPLOSIVE

[75] Inventors: David A. Ciaramitaro, Benson, Ariz.; David J. Speltz, Spring Valley, Calif.; Jack M. Moore, Benson, Ariz.

[73] Assignee: Apache Powder Company, Benson, Ariz.

[21] Appl. No.: 839,757

[22] Filed: Mar. 14, 1986

[51] Int. Cl.[4] ..... C06B 45/02

[52] U.S. Cl. ..... 149/21; 149/2; 149/42; 149/43; 149/44; 149/60; 149/61; 149/76; 149/83; 149/109.6; 149/114

[58] Field of Search ..... 149/2, 21, 42, 43, 44, 149/60, 61, 76, 83, 109.6, 114

[56] References Cited

U.S. PATENT DOCUMENTS

| | | | |
|---|---|---|---|
| 3,361,603 | 1/1968 | Griffith | 149/38 |
| 3,507,718 | 4/1970 | Mortensen et al. | 149/3 |
| 3,819,429 | 6/1974 | Schaefer | 149/21 |
| 4,077,820 | 3/1978 | Bolza et al. | 149/109.4 |
| 4,140,561 | 2/1979 | Keith et al. | 149/2 |
| 4,435,232 | 3/1984 | Ciaramitaro et al. | 149/2 |
| 4,439,254 | 3/1984 | Mullay | 149/2 |

*Primary Examiner*—Stephen J. Lechert, Jr.

*Attorney, Agent, or Firm*—Townsend & Townsend

[57] ABSTRACT

High density water gel explosives having relatively large amounts of low density sensitizers are prepared by evenly dispersing a densifying material therethrough. Separation of the densifying material during the mixing and packaging of the water gel explosive is prevented by adding from about 0.1 to 2% comminuted paper to the water gel. It has been found that the paper greatly increases the viscosity of the composition, so that the heavier densifying materials do not settle out. The paper has also been found to contribute to the stability of the explosive gel over prolonged storage periods.

16 Claims, No Drawings

HIGH DENSITY GEL EXPLOSIVE

BACKGROUND OF THE INVENTION

1. Field of the Invention

The present invention relates generally to explosive compositions, and more particularly to explosives comprising water soluble ammonium salts combined with fuels and sensitizers, commonly referred to as water gel or slurry explosives.

Water gel or slurry explosives are formed by dispersing fuel and sensitizer components in a saturated or unsaturated aqueous solution of an oxidizing salt, typically including ammonium nitrate. Suitable fuels include various hydrocarbons, coal dust, urea, sulfur, and the like, while suitable sensitizers include both explosive compounds, such as trinitrotoluene, and low density components, such as finely divided aluminum, dispersed gas bubbles, microballoons, or finely divided porous solids. In addition to the fuels and sensitizers, water gel explosives require the addition of a gelling agent, such as guar gum, carboxymethyl cellulose, polyacrylamides, and the like. Other components, such as cross-linking agents, may also be added in order to obtain desired characteristics of the explosive.

For use in down hole blasting applications, water gel explosives are typically packaged by pouring the still liquid slurry into small polyethylene bags or "chubs" for loading into the bore holes.

Cross-linking agents added to the slurry act after packaging to thicken the slurry into its final form. A problem has been recognized in water gel explosives having relatively high contents of low density sensitizers, such as flake aluminum. In some cases, the specific gravity of the resulting composition is below 1.0, and the packaged explosive will tend to float in bore holes which are filled with water. While the density may be increased by the addition of high density components, such components have a tendency to settle out of the gel during the mixing and packaging operations.

It would therefore be desirable to provide methods and compositions for suspending high density components in water gel explosives in a manner which limits or prevents their settling out. It would be particularly desirable to provide such methods and compositions which also improve other characteristics of the explosive at the same time.

2. Description of the Background Art

Water gel explosives of the general type of the present invention are generally described in the following U.S. Pat. Nos. 3,819,429 to Schaefer; 4,077,820 to Bolza et al.; and 4,439,254 to Mullay. See in particular U.S. Pat. Nos. 3,819,429 and 4,439,254 which further describe the addition of various densifying agents. U.S. Pat. No. 3,361,603 to Griffith describes the addition of ground paper to explosive compositions of all types in order to reduce the density of the explosive. U.S. Pat. No. 3,507,718 to Mortensen et al., describes the addition of fibrous fuels, such as wood pulp and ground alfalfa, which may be treated with water repellents so that they can establish tiny gas or air pockets and serve as sensitizers. U.S. Pat. No. 4,140,561 to Keith et al. describes the addition of fibrous materials, and in particular synthetic fibers such as rayon, and polyethylene, in order to improve the stability and increase the viscosity of the resulting explosive composition. U.S. Pat. No. 4,435,232, to Ciaramitaro et al., describes the addition of processed cellulose, such as comminuted paper, to liquid-based explosives, such as nitroglycerine dynamite, to form a water-resistant composition.

SUMMARY OF THE INVENTION

According to the present invention, high density water gel explosives having large amounts of low density sensitizers are prepared by uniformly dispersing a densifying material, such as ferrophosphorous, throughout the explosive composition. The densifying material is held in suspension during mixing and packaging operations by the addition of a small amount of comminuted paper, typically between about 0.5 and 1% by weight, in order to thicken the slurry sufficiently to inhibit settling of the densifying material while still allowing mixing and handling of the gel composition. Typically, the viscosity of the gel will be increased to at least about 5500 cp. In addition to maintaining the suspension, the comminuted paper appears to accelerate cross-linking of the gel after packaging and to stabilize the explosive velocity of the composition over relatively long periods of storage.

DESCRIPTION OF THE PREFERRED EMBODIMENTS

The water gel explosives of the present invention are characterized by relatively high amounts of low density sensitizers which would normally result in a product having a specific gravity below 1.0. Such low density water gels are undesirable for the reasons described above. To increase the specific gravity to above 1.0, high density materials, referred to as densifying materials, are added to the water gel. Comminuted paper is added prior to the addition of the densifying material, where the comminuted paper acts both to increase the viscosity of the water gel to inhibit settling out of the densifying material during mixing and processing and to stabilize the composition of the water gel explosive over prolonged storage periods. The viscosity of the gel will be increased to at least about 5500 cp, preferably at least about 7500 cp, in order to support the densifying material without substantial precipitation.

Comminuted paper useful for practice of the present invention may be derived from a variety of sources, typically waste sources such as newspaper, computer paper, cardboard, and the like. The comminuted paper may be produced by grinding in a high-speed hammer mill having $\frac{1}{8}''$ screen openings, or smaller. The paper will generally be cleaned to remove loose debris prior to grinding, but will be otherwise untreated. In addition to acting to increase the viscosity, it has been found that the paper alone increases the density of the water gel formulations of the present invention. This is particularly surprising in view of the prior art teaching of U.S. Pat. No. 3,361,603 to Griffith that ground paper is added to various types of explosives as a density-reducing component.

The densifying materials useful in the present invention are typically powdered iron alloys such as ferrophosphorous, ferrosilicon, ferromanganese, ferrotitanium, ferrotungsten, ferrovanadium, and the like. The densifying materials are oxidized during the explosive reaction of the composition, and thus contribute to the fuel content of the composition as well as providing for the increased density. Particularly preferred is ferrophosphorous which is relatively inexpensive and more stable than some of the other ferroalloys listed.

The remaining components of the high density water gel explosive of the present invention include at least one oxygen supplying salt dissolved in water, a gelling agent to thicken the salt solution, and a low density sensitizer to increase the ignition sensitivity of the resulting explosive composition. Normally, other components will be added, such as fuels, cross-linking agents, inhibitors, and other components.

Suitable oxygen-supplying salts include strong oxidizing salts such as ammonium nitrate, sodium nitrate, ammonium perchlorate, sodium perchlorate, and other alkaline and alkaline earth nitrates and perchlorates. The compositions will always include ammonium nitrate as the major oxidizing salt, both because it is readily available and inexpensive and because it is itself an explosive compound. The salts will be dissolved in water and may be saturated or unsaturated, typically being saturated. Ammonium nitrate will typically comprise at least 50% of the total amount of oxidizing salts in the composition, usually being at least 60%, more usually being at least 75% or higher, with one or more of the remaining salts making up the balance.

Various suitable gelling agents are available, including natural gums such as guar gum, xanthan gum, gum tragacanth, carboxymethyl cellulose, and the like; and synthetic gelling agents, such as polyacrylamide. The gelling agents are added in a sufficient amount to interact and form a three-dimensional structure within the water solvent. Typically, from 1 to 5% by weight gelling agent is added.

The gelling agents will usually be combined with a slow-acting cross-linking agent, which will act to cross-link the gelling agent after a predetermined time. Typically, the slow-acting cross-linking agents are selected to react after approximately one hour so that the water gel does not set until the composition has been packaged. Suitable gelling agents having slow-acting cross-linking agents are available from Celanese Water Soluble Polymers, Louisville, Kentucky.

The low density sensitizers are selected to introduce small interstitial spaces or discontinuities within the water gel explosive composition in order to provide adiabatic compression sites or "hot spots." Suitable sensitizers include finely divided aluminum powders, microballoons, other small porous salts, and air bubbles dispersed within the composition by mixing air into the composition. Such low density sensitizers and methods for their introduction into the water gel explosive are well known in the prior art.

In addition to the above components, the water gel explosive will normally contain a fuel to increase the energy available in the combustion of the water-gel explosive. The fuel may be any combustible material, and many of the previously-identified components will also act as fuels in that they undergo exothermic oxidation during the combustion of the explosion. All of the densifiers identified, as well as the aluminum flake sensitizer, are fuels in that they contribute to the energy of the composition as described above. Supplemental water-soluble fuels may also be added, such as ethylene glycol, formamide, and the like. Both of these materials also act to prevent the precipitation of the oxygen supplying salts at lower temperatures. Other conventional fuels include coal dust, urea, and sulfur.

A table setting forth the components of the water gel explosive of the present invention in the amounts of each component in the overall formulation is set forth below.

TABLE 1

| Component | Exemplary Components | Preferred Composition[1] Broad | Preferred Composition[1] Narrow |
|---|---|---|---|
| Oxygen Supplying Salt(s)[2] | $NH_4NO_3$, $NaNO_3$, $NH_4ClO_4$, $NaClO_4$ | 60–90% | 60–80% |
| Gelling Agent(s)[3] | Guar gum, Carboxymethyl cellulose, and polyacrylamide | 1–5% | 1–3% |
| Ground paper | Ground newsprint | 0.1–2% | 0.5–1.0% |
| Sensitizer(s) | Flake Aluminum[4], Microballoons; and Entrained Air[5] | 3–10% | 5–10% |
| Densifier | Ferrophosphorous and Ferrosilicon | 0.5–10% | 3–9% |
| Fuel(s) | Formamide, Ethylene glycol, Coal dust, Urea; and Sulfur | 0–10% | 3–8% |
| Inhibitor(s) | Potassium dichromate | 0.1–1% | 0.1–0.2% |

[1]Weight percent.
[2]Present in aqueous solution.
[3]Usually a slow-acting cross-linking agent will be combined with the gelling agent prior to addition to the mix.
[4]Flake aluminum will also act as a fuel.
[5]Entrained air is present in an amount sufficient to introduce a void volume in the range from 1 to 10%, usually from 5 to 10%.

The water gel explosives may be prepared in large mixed tank reactors, usually holding from 100 to 1,000 pounds of the water gel composition. The dissolved oxygen-supplying salts are first added to the mix tank, followed by the addition of the gelling agent and the newsprint. These three components are then mixed until a thickened gel has been formed and the consistency of the gel becomes constant. The densifying materials are next added, and the composition again mixed until the densifying materials have become evenly dispersed throughout. At this point, the low density sensitizer is added or the mixture is vigorously mixed with air in order to induce bubbles into the mixture. In either case, sufficient mixing is performed to evenly disperse the low density sensitizer so that the density of the composition is uniform. The remaining components of the explosive gel are then added and mixed in, as desired.

Once the bulk explosive composition has been prepared, the composition is packed into individual containers, such as metal, cardboard, paper, or plastic containers. A variety of such containers are well known in the prior art, and need not be described further. Particularly preferred, are small polyethylene bags capable of holding from 1 to 10 pounds of the explosive composition, more usually from about 2 to 5 pounds. These polyethylene bags are filled and sealed at both ends to form the explosive packages. These packages may then be employed in various blasting operations in the conventional manner.

The following examples are offered by way of illustration, not by way of limitation.

EXPERIMENTAL

Four examples were prepared having the formulations set forth in Table 2. Example 1 is a basic water gel explosive, without additives for density control. Normal production of such a formulation yields densities that vary from less than 1.0 gm/cc to the value shown. Example 2 shows the effect of the addition of ferrophosphorus to the mix of Example 1. No density increase was observed, and the ferrophosphorus was found to be precipitated to the bottom surfaces of all the process equipment. Example 3 shows that density is significantly increased by the addition of ground newsprint to the mixture. Example 4 shows an even greater increase in the mix density through the addition of both ground newsprint and ferrophosphorus. The amount of ferrophosphorus which was found precipitated in the process equipment was negligible compared to the precipitation in Example 2.

The uncrosslinked guar mixtures are thixotropic in nature before crosslinking is accomplished. They will buoy dense materials only if the mixture is left undisturbed. When the mixture is disturbed, as by extra mixing, pumping or conveying to the packaging machine, the shear forces cause the viscosity of the moving mixture to drop to a level that can no longer support a densifying agent. The agent then precipitates to the bottom of the mixture. This effect is most important in a production situation, where large quantities of the mixture are moved and handled. On a laboratory scale (5 lb or less) the thixotropic effect is masked by the greater control that the operator has over the mixture.

TABLE 2

| Ingredient | Example 1 | Example 2 | Example 3 | Example 4 |
|---|---|---|---|---|
| Ammonium Nitrate | 49.8% | 46.1% | 49.4% | 45.8% |
| Sodium Nitrate | 14.9% | 13.8% | 14.7% | 13.7% |
| Water | 16.1% | 14.9% | 15.9% | 14.8% |
| Formamide | 5.6% | 5.2% | 5.6% | 5.2% |
| Ethylene Glycol | 2.4% | 2.2% | 2.4% | 2.2% |
| Sodium Dichromate | 0.002% | 0.002% | 0.002% | 0.002% |
| Gelling Agent (Guar Gum) | 1.6% | 1.5% | 1.6% | 1.5% |
| Flake Aluminum | 9.6% | 8.9% | 9.6% | 8.9% |
| Ferrophosphorus (−200 mesh) | 0 | 7.4% | 0 | 7.4% |
| Ground Newsprint | 0 | 0 | 0.75% | 0.70% |
| Density, gm/cc | 1.04 | 1.04 | 1.09 | 1.15 |

Although the foregoing invention has been described in some detail by way of illustration and example for purposes of clarity of understanding, it will be obvious that certain changes and modifications may be practiced within the scope of the appended claims.

What is claimed is:

1. A method for producing a water gel explosive composition, said method comprising:

combining a water solution of an oxygen-supplying salt and a gelling agent with an amount of comminuted paper sufficient to increase the viscosity of the mixture to a preselected level while continuously mixing the resulting combination;

thereafter adding an amount of a densifying agent sufficient to increase the specific gravity and introducing a preselected amount of an inert sensitizer to the combination; and packing the resulting composition into containers, whereby the densifying agent remains substantially uniformly dispersed in the explosive composition.

2. A method as in claim 1, wherein the viscosity is increased to above about 5500 cp.

3. A method as in claim 1, wherein the comminuted paper is added in an amount equal to about 0.1 to 2% by weight of the composition.

4. A method as in claim 1, wherein the oxygen supplying salt is at least one salt selected from the group consisting of ammonium nitrate sodium nitrate, ammonium perchlorate, and sodium perchlorate.

5. A method as in claim 4, wherein ammonium nitrate and sodium nitrate are in the water solution.

6. A method as in claim 1, wherein the solution of the oxygen-supplying salt is saturated.

7. A method as in claim 1, wherein the gelling agent is selected from the group consisting of guar gum, carboxymethyl cellulose, and polyacrylamide.

8. A method as in claim 7, wherein the gelling agent is guar gum.

9. A method as in claim 1, wherein the gelling agent includes a cross-linking agent.

10. An explosive composition comprising:

an oxygen-supplying salt dissolved in water, an agent for gelling the salt solution and an amount of comminuted paper sufficient to increase the viscosity of the gelled salt solution to above about 5500 cp;

aluminum powder added in an amount equal to about 3 to 10 weight percent of the final composition; and a densifying material added in an amount sufficient to increase the specific gravity of the final composition to about 1.0.

11. An explosive composition as in claim 10, wherein the ground paper was added in an amount equal to about 0.1 to 2.0 weight percent of the final composition.

12. An explosive composition as in claim 10, wherein the oxygen-supplying salt is selected from the group consisting of ammonium nitrate, sodium nitrate, ammonium perchlorate, and sodium perchlorate.

13. An explosive composition as in claim 12, wherein the oxygen-supplying salt is a mixture of ammonium nitrate and sodium nitrate.

14. An explosive composition as in claim 10, wherein the gelling agent is selected from the group consisting of guar gum, carboxymethyl cellulose, and polyacrylamide.

15. An explosive composition as in claim 14, wherein the gelling agent is guar gum.

16. An explosive composition as in claim 10, wherein the gelling agent includes a cross-linking agent.

* * * * *